United States Patent [19]

Kawai et al.

[11] Patent Number: 4,531,894

[45] Date of Patent: Jul. 30, 1985

[54] SEALED TYPE MOTOR COMPRESSOR

[75] Inventors: Hideki Kawai; Hidetoshi Nishihara; Seishi Nakaoka; Koushi Hamada, all of Fujisawa, Japan

[73] Assignee: Matsushita Reika Co., Ltd., Osaka, Japan

[21] Appl. No.: 604,403

[22] Filed: Apr. 27, 1984

Related U.S. Application Data

[63] Continuation of Ser. No. 407,905, Aug. 13, 1982, abandoned.

[30] Foreign Application Priority Data

| | | | |
|---|---|---|---|
| Aug. 25, 1981 | [JP] | Japan | 56-132850 |
| Oct. 26, 1981 | [JP] | Japan | 56-159183[U] |
| Mar. 18, 1982 | [JP] | Japan | 57-44270 |
| Mar. 18, 1982 | [JP] | Japan | 57-44271 |

[51] Int. Cl.[3] ..... F04B 35/00; F04B 37/00; F16L 21/00

[52] U.S. Cl. ..... 417/312; 417/363; 417/902; 181/255; 285/235

[58] Field of Search ..... 417/902, 363, 540, 542, 417/312; 92/295, 296; 285/223, 226, 235, 318; 181/403, 240, 255, 264, 272, 281

[56] References Cited

U.S. PATENT DOCUMENTS

| | | | |
|---|---|---|---|
| 1,015,955 | 1/1912 | Helder | 181/281 X |
| 1,927,947 | 9/1933 | Newell | 417/312 |
| 2,068,187 | 1/1937 | Lewis | 285/235 X |
| 2,213,325 | 9/1940 | Nystrom | 417/902 |
| 3,750,840 | 8/1973 | Holme | 181/403 X |
| 4,086,032 | 4/1978 | Nishioka et al. | 417/902 |
| 4,111,278 | 9/1978 | Bergman | 181/403 X |
| 4,240,774 | 12/1980 | Ladusaw | 417/902 X |
| 4,370,104 | 1/1983 | Nelson | 417/312 |

*Primary Examiner*—Carlton R. Croyle
*Assistant Examiner*—Theodore Olds
*Attorney, Agent, or Firm*—Stevens, Davis, Miller & Mosher

[57] ABSTRACT

A sealed type motor compressor includes a motor section, a compressor section, a sealed enclosure for resiliently supporting therein the motor section and the compressor section, a suction pipe extending through the sealed enclosure, a suction muffler mounted on the compressor section, an insert pipe received at its one end in an inlet port with a slight clearance therebetween, and a closely coiled spring in the form of a cylinder for interposing between the suction pipe and the insert pipe. A communication pipe is adapted to extend through an aperture formed in the muffler and to be forcedly fitted into a suction port formed in a cylinder head, thereby serving to connect the muffler to the cylinder head.

2 Claims, 5 Drawing Figures

SEALED TYPE MOTOR COMPRESSOR

This application is a continuation, of application Ser. No. 407,905, filed 8/13/82 now abandoned.

BACKGROUND OF THE INVENTION

This invention relates to a sealed type motor compressor for use with refrigerators, air conditioners and the like, and more specifically to such motor compressors in which a refrigerant gas is delivered directly to a cylinder through a suction muffler from a suction pipe.

In prior art motor compressor, a sealed enclosure is used as a low pressure vessel such that a suction refrigerant gas of low temperatures and low pressure returned through a suction pipe is temporarily stored in a space defined by a sealed enclosure and is then sucked into the suction side of a compressor section. However, such temporary storage of the suction refrigerant gas in the sealed enclosure causes the gas to be exposed to heat generated from the motor section and the compressor section, so that when sucked into the compressor section, the gas becomes substantially high in temperature. Thus the discharge refrigerant gas becomes correspondingly high in temperature to have a disadvantageous influence on itself as well as on a lubricant oil and other elements and to lower the volumetric efficiency of the compressor section.

In an effort to eliminate the above drawback, direct supplying of a suction refrigerant gas into a compressor section is well-known as in U.S. Pat. Nos. 4,086,032 to Nishioka et al, and 4,242,056 to Dyhr et al. However, such arrangement for directly delivering the suction refrigerant gas to a suction muffler or a cylinder is unfavorable in that connections therefor become complicated and assembly thereof is troublesome. In addition, in case the suction refrigerant gas is directly delivered to the cylinder, liquid refrigerant and circulating oil contained in the refrigerant gas flow directly into the compressor to cause liquid compression and oil compression which can possibly be sources for great troubles such as failures of valve portions, a crank shaft and a connecting rod. In dealing with the problem, Dyhr et al patent proposes the provision of an oil-gas separator outside the compressor casing, which makes the apparatus large in size.

SUMMARY OF THE INVENTION

It is an object of the invention to eliminate the above problems involved in the prior art.

It is another object of the invention to provide a simple construction adapted for easy assembling and extended through a sealed enclosure of a compressor for directly delivering a suction gas to a muffler.

It is a further object of the invention to provide a sealed type motor compressor of such a construction in which the muffler is mounted on a cylinder head without resorting to brazing or glueing.

It is still another object of the invention to provide a sealed type motor compressor in which the muffler is formed of a material of easy fabricability such as synthetic resins into a shape such that mounting of the muffler is relieved from any failure due to thermal expansion.

It is yet further object of the invention to provide a sealed type motor compressor in which the muffler is effective for oil-gas separation and is easy to assemble.

It is yet another object of the invention to provide a sealed type motor compressor adapted for quiet operation.

The invention will be better understood by means of the description which follows in connection with attached drawings given by way of example.

DESCRIPTION OF THE PREFERRED EMBODIMENT

Figure 1:
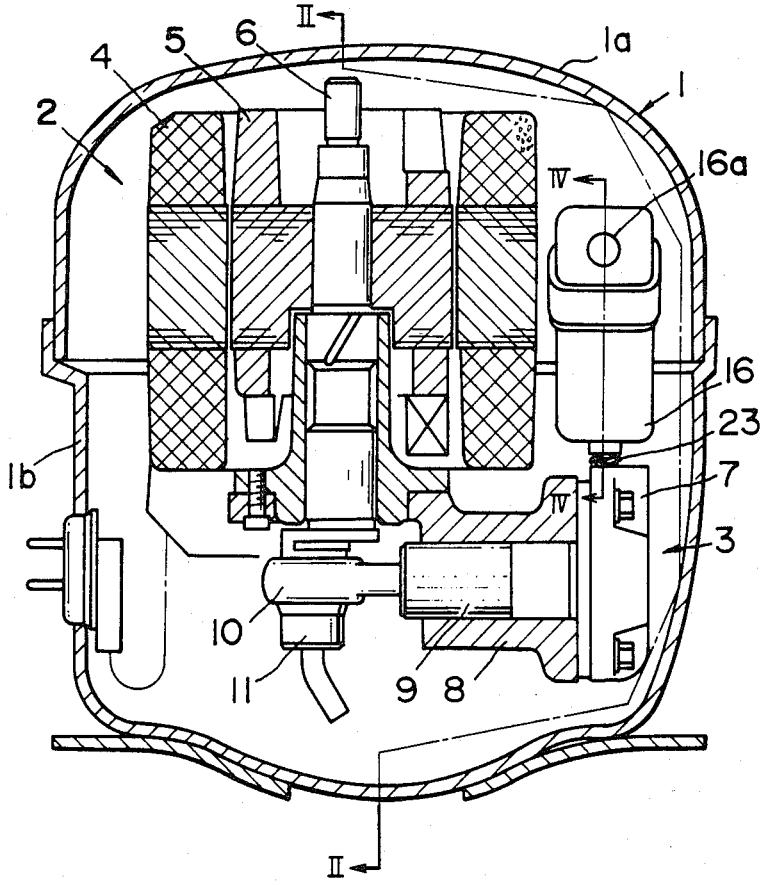
FIG. 1 is a sectional view of a sealed type motor compressor according to an embodiment of the invention.
Figure 2:
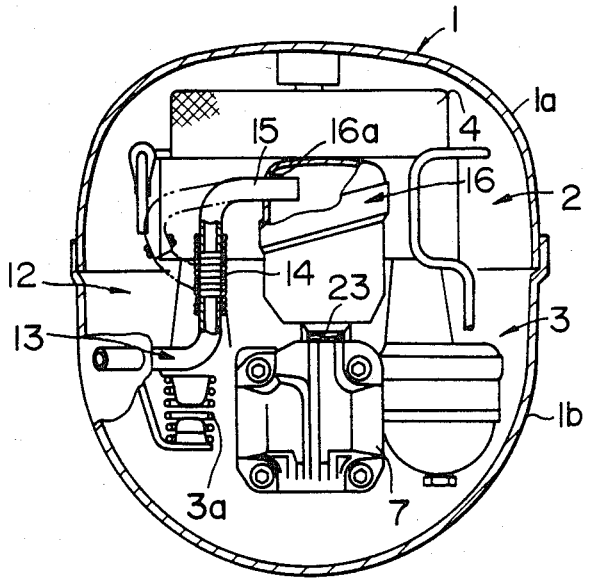
FIG. 2 is a sectional view taken along the line II—II in FIG. 1.

Referring now to FIG. 1 of the drawing, there is shown a sealed type motor compressor according to an embodiment of the invention, which comprises a motor section 2 and a compressor section 3, respectively contained in a sealed enclosure 1 consisting of an upper casing 1*a* and a lower casing 1*b*. The motor section 2 comprises a stator 4, a rotor 5 and a crank shaft 6 directly secured to the rotor 5. The compressor section 3 comprises a cylinder head 7, a cylinder 8, a piston 9 and a connecting rod 10 connected to an excentric portion 11 of the crank shaft 6. When the motor section 2 is energized to rotate the crank shaft 6, movements transmitted through the eccentric portion 11 and the connecting rod 10 causes the piston 9 to reciprocate within the cylinder 8, thereby effecting suction, compression and discharge of a refrigerant gas in a known manner. In FIG. 2, a suction gas supply passage 12 comprises a suction pipe 13 fixed to the sealed enclosure 1 and extending upright interiorly thereof, a closely coiled spring 14 fitted at its lower end on the suction pipe 13 and being in the form of a cylinder made of a coiled wire, an insert pipe 15 securely fitted into the top of the coiled spring 14, and a suction muffler 16 into which the insert pipe 15 extends. The coiled spring 14 has a sufficient stiffness to support the insert pipe 15 extending into the suction muffler 16. There is provided a minimum clearance between the insert pipe 15 and an inlet port 16*a* of the suction muffler 16 to permit the insert pipe 15 to slide therethrough.

Figure 3:
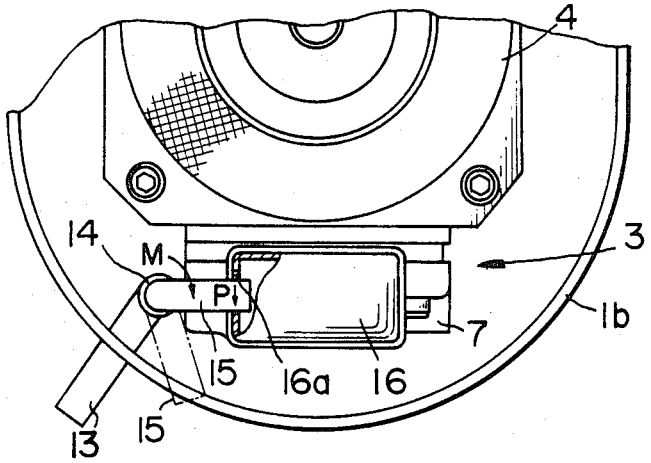
FIG. 3 is a top plan view of the essential parts of the motor compressor of FIG. 1 with an upper casing removed.

As shown in FIG. 3 from which the upper casing 1*a* is omitted, the insert pipe 15 is initially mounted on the coiled spring 14 in the position as shown by phantom line, and is then turned in the anti-clockwise direction to be inserted into the inlet port 16*a* of the suction muffler 16, as shown by solid line. Thus the coiled spring 14 exerts a torsional moment M on the insert pipe 15 to produce a biasing force P between the insert pipe 15 and the inlet port 16*a*.

Figure 4:
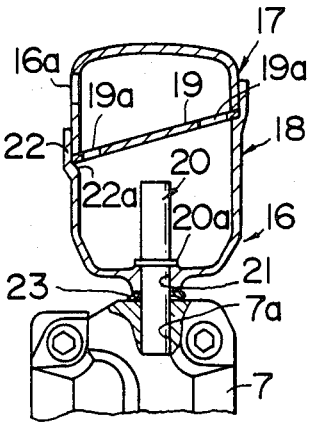
FIG. 4 is a sectional view taken along the line IV—IV in FIG. 1.
Figure 5:
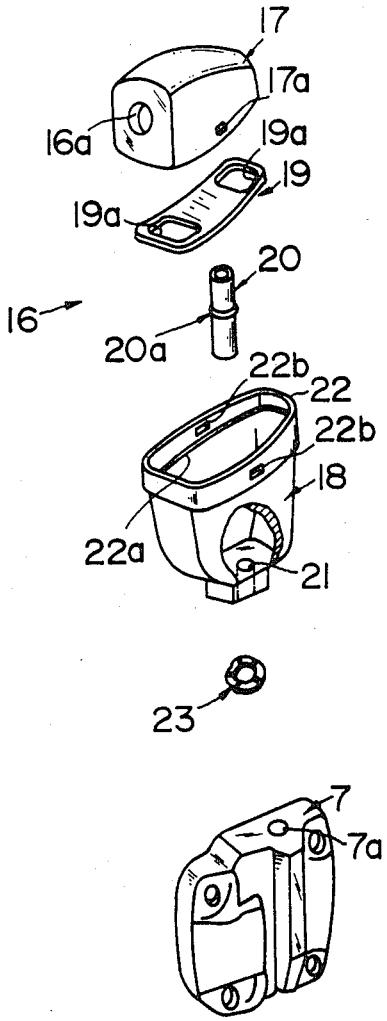
FIG. 5 is an exploded perspective view of a muffler in the motor compressor in FIG. 1.

The suction muffler generally designated at numeral 16 is formed by injection molding from refrigerant resistant, oil resistant and heat resistant plastics such as polybuthlene terephthalate, and is disposed away from the compressor section. As shown in FIG. 4, the suction muffler 16 comprises a cup-shaped closure member 17, a cup-shaped body 18 and a partition plate 19. The cup-shaped body 18 is formed at its bottom with an aperture 21 through which extends a communication pipe 20 supportingly fitted into a suction port 7*a* of the cylinder head 7. The cup-shaped body 18 is also formed at its opening end with a sleeve portion 22 and a flat stepped portion 22*a*. The closure member 17 includes at its front and rear surfaces a pair of latches 17*a* adapted to engage with apertures 22*b* formed in the cup-shaped body 18. The partition plate 19 is formed with a pair of through holes 19*a* and is bent to be curved gradually from its center toward its right and left ends. The communication pipe 20 includes an integral flange 20*a* adapted to engage the peripheral edge of the aperture 21. The suction port 7*a* formed in the cylinder head 7 is communicated to a low pressure chamber (not shown) which in turn is communicated with a low pressure valve (not shown) provided in the cylinder head. A resilient member 23 such as a corrugated washer is mounted around the periphery of the communication pipe 20 between the cup-shaped body 18 and the cylinder head 7. In assembling the suction muffler 16 to the cylinder head 7, the communication pipe 20 is inserted through the aperture 21 of the cup-shaped body 18 from inward thereof, and the resilient member 23 is set in place on the communication pipe 20, after which the pipe 20 is forcedly inserted into the suction port 7*a* of the cylinder head 7. In this position, the extent to which the communication pipe 20 is forced into the suction port 7*a* is such that the resilient member 23 is compressed to its minimum thickness against its elasticity at room temperatures, or alternatively is such that the resilient member 23 still remains slightly compressible allowing for expansion of the cup-shaped body 18 (more specifically, linear expansion of the body 18 plus linear expansion of the communication pipe 20) at high temperatures in operation. Thereafter the partition plate 19 is placed in abutting relation to the stepped portion 22*a* of the cup-shepd body 18, after which the closure member 17 is urged against the elasticity of the partition plate 19 into the sleeve portion 22 of the body 18 to cause the latches 17 to engage the apertures 22*b*. As described above, it is to be noted that the insert pipe 15, the suction pipe 13 fixed to the lower casing 1*b* and the coiled spring 14 are previously assembled with the insert pipe 15 in the position as shown by phantom line in FIG. 3.

A unit consisting integrally of the motor section 2 and the compressor section 3 is contained and assembled in the following manner. The compressor section 3 is initially placed through a spring 3*a* in the lower casing 1*b*. In this position, the insert pipe 15 can be freely moved due to the elasticity of the coiled spring 14 as shown by phantom line in FIG. 2, so that a torsional moment M is imparted to the coiled spring 14, that is, the spring 14 is twisted from the position as shown by phantom line in FIG. 3 to the position as shown by solid line, to permit insertion of the insert pipe 15 into the inlet port 16*a* of the muffler 16, thus completing assembling. Accordingly, assembly of the motor compressor can be easily and rapidly effected, and the abutting force P is produced between the inlet port 16*a* of the muffler 16 and the insert pipe 15 owing to the torsional moment M to enable reducing humming sounds which would otherwise be produced between the inlet port 16*a* and the insert pipe 15.

The direction of torsion for producing the torsional moment M is not decisive, and either of the directions of winding and unwinding the coiled spring 14 will suffice. However, the winding direction is preferable in increasing closeness between the coiled spring 14 and the insert pipe 15 or the suction pipe 13.

In the arrangement as described above, the suction gas supply passage 12 is constituted by successively connecting the suction pipe 13, the closely coiled spring 14, the insert pipe 15 and the suction muffler 16, and is isolated from the heat generated by the compressor section 3. Accordingly, the suction gas is directly sucked in the suction muffler 16 without being exposed to the environment of high temperatures. In addition, the suction muffler 16 is connected through the insert pipe 15 and the coiled spring 14 to the suction pipe 13, so that it can follow relative movements of the elements of the compressor section provided in the sealed enclosure in the normal direction and in the upward and downward direction to reduce vibrations transmitted to the sealed enclosure from the elements of the compressor section. As described above, the insert pipe 15 is fitted in the suction muffler 16 with the minimum clearance therebetween required for sliding movements, so that it is moved in contact with the opening of the suction muffler 16 upon movements of the elements of the compressor section in the peripheral direction to mitigate load on the closely coiled spring 14. The minimum clearance between the insert pipe 15 and the opening of the suction muffler 16 which permits sliding movements therebetween prevents leakage of the refrigerant and mitigates resounding produced from the pulsation within the suction muffler. In addition, the torsional moment produced in the closely coiled spring gives rise to a force by which the insert pipe urges the inlet port of the suction muffler, so that any humming sounds which would otherwise be produced therebetween can be reduced, and rapid and simple assembly of the motor compressor can be performed.

It will be understood that various modifications and changes which may be made come within the spirit of this invention and all such changes and modifications coming within the scope of the appended claims are embraced thereby.

What is claimed is:

1. A sealed type motor compressor comprising a motor section and a compressor section resiliently supported within a sealed enclosure, a suction pipe extending through a side wall of said sealed enclosure, a suction muffler disposed on a side wall of said compressor section, and an insert pipe inserted into and extending into the interior of said sealed enclosure with a slight clearance between it and an inlet port formed in a side wall of said suction muffler, and a closely coiled spring in the form of a cylinder secured to said suction pipe and said insert pipe for interconnecting them, said closely coiled spring having a torsional moment which provides a biasing force causing said insert pipe to abut against said inlet port, said suction muffler including a cup-shaped body formed of a synthetic resin and divided into at least upper and lower sections, a closure member covering an opening of said body and a partition plate mounted between said body and said closure member, said cup-shaped body being open at its top surface and formed at its bottom surface with an aperture, through which a communication pipe is fitted into a suction port formed in said compressor section to securely support said cup-shaped body, said partition plate being formed with a through hole, having a position which is offset from an extension of said communication pipe, said inlet port being provided on the side of said closure member.

2. A sealed type motor compressor comprising a motor section and a compressor section resiliently supported within a sealed enclosure; a suction pipe having a portion extending into said sealed enclosure; a suction muffler fixed to said compressor section, said suction muffler including a cup-shaped body formed of a synthetic resin and divided into at least two sections, a closure member covering an opening of said body, a curved partition plate formed with a through hole and resiliently interposed between said body and said closure member, apertures formed on one of said body and said closure member, and latches formed on the other of said body and said closure member and adapted for engagement with said apertures, said body being formed with an aperture for receiving a communication pipe having a flange for engagement with a peripheral edge of said aperture, said suction muffler being secured to a cylinder head by inserting said communication pipe into said aperture of said body and forcedly fitting said communication pipe into a suction port formed in said cylinder head while placing a resilient member around the periphery of said communication pipe between said suction muffler and said cylinder head; an insert pipe adapted to extend through an inlet port of said suction muffler with a slight clearance therebetween; and a closely coiled spring in the form of a cylinder interposed between said suction pipe portion extending into said sealed enclosure and said insert pipe; said closely coiled spring being secured to said suction pipe portion and insert pipe and having a given torsional moment to provide a biasing force acting between said inlet port and said insert pipe.

* * * * *

UNITED STATES PATENT AND TRADEMARK OFFICE

CERTIFICATE OF CORRECTION

PATENT NO. : 4,531,894

DATED : July 30, 1985

INVENTOR(S) : Hideki KAWAI et al

It is certified that error appears in the above—identified patent and that said Letters Patent is hereby corrected as shown below:

On the title page, Item [73] should read as follows:

-- [73] Assignee: Matsushita Reiki Co., Ltd., Osaka, Japan --

Signed and Sealed this

Fourteenth Day of January 1986

[SEAL]

*Attest:*

*Attesting Officer*

DONALD J. QUIGG

*Commissioner of Patents and Trademarks*